US009070348B2

(12) United States Patent
Takegawa

(10) Patent No.: US 9,070,348 B2
(45) Date of Patent: Jun. 30, 2015

(54) CYMBAL STAND AND METHOD FOR SETTING UP THE SAME

(71) Applicant: Akito Takegawa, Chiba (JP)

(72) Inventor: Akito Takegawa, Chiba (JP)

(73) Assignee: PEARL MUSICAL INSTRUMENT CO., Chiba (JP)

( * ) Notice: Subject to any disclaimer, the term of this patent is extended or adjusted under 35 U.S.C. 154(b) by 290 days.

(21) Appl. No.: 13/740,891

(22) Filed: Jan. 14, 2013

(65) Prior Publication Data

US 2014/0196589 A1 Jul. 17, 2014

(51) Int. Cl.
*G10D 13/02* (2006.01)
*G10D 13/06* (2006.01)

(52) U.S. Cl.
CPC ..... *G10D 13/06* (2013.01); *Y10T 29/49826* (2015.01)

(58) Field of Classification Search
USPC ..... 84/422.1, 422.3
See application file for complete search history.

(56) References Cited

U.S. PATENT DOCUMENTS

| | | | | |
|---|---|---|---|---|
| 2,138,067 | A * | 11/1938 | Mossberg | 359/424 |
| 5,739,447 | A * | 4/1998 | Hoshino | 84/402 |
| 8,106,277 | B2 | 1/2012 | Barnett et al. | |
| 2012/0210843 | A1 | 8/2012 | Sato | |

* cited by examiner

*Primary Examiner* — Jianchun Qin
(74) *Attorney, Agent, or Firm* — Manelli Selter PLLC; Edward J. Stemberger

(57) ABSTRACT

A cymbal stand for mounting at least one cymbal. The cymbal stand comprises a base assembly including a base pipe, a support pipe assembly including a first support pipe, and a first locking clamp for releasably locking said first support pipe and said base pipe together. The base pipe has an upper end and a longitudinal axis. The first support pipe has a length, opposite terminal ends and a first longitudinal axis along the length. The first support pipe is telescopically and coaxially movable relative to the base pipe. The first support pipe is connected to the base pipe along the longitudinal axis of the first support pipe by the first locking clamp at a nodal point of the first support pipe.

28 Claims, 5 Drawing Sheets

CYMBAL STAND AND METHOD FOR SETTING UP THE SAME

BACKGROUND OF THE INVENTION

1. Field of the Invention

The present inventions relates to cymbal stands in general, and more particularly to a cymbal stand with pipes and rods of the cymbal stand positioned at their respective nodal points and a method for setting up the cymbal stand.

2. Description of the Related Art

Cymbal stands are known to support one or more cymbals. Such stands typically includes two or more telescoping support pipes defining a stand body, and a leg assembly defining a tripod for supporting the support pipes in a generally perpendicular orientation relative to a floor surface. The cymbal stands often further include a boom rod supported by the stand body and having a cymbal holder at one of distal ends of the boom rod. The boom rod is coupled to an upper end of the stand body at a desired location along the boom rod. It is possible to extend the boom rod like an arm for arranging the cymbal in the drum set, thereby making it possible to use the cymbal in a drum set with a large number of drums.

Typically, the cymbal stands comprise one fixed cymbal resting on a cymbal holder at the distal end of the boom rod or on top of the stand body, or two cymbals (hi-hats) including a lower fixed cymbal resting on the cymbal holder at the distal end of the boom rod or on top of the stand body, and an upper movable cymbal fixed on top of a moveable pull rod. The stand also includes one or more locking clamps for releasably locking the support pipes together.

While known cymbal stands, including but not limited to the discussed above, have proven to be acceptable for various cymbal stand applications, such cymbal stands are nevertheless susceptible to improvements that may enhance their performance. With this in mind, a need exists to develop a cymbal stand that advances the art by optimizing and improving cymbal sound.

SUMMARY OF THE INVENTION

A first aspect of the present invention provides a novel cymbal stand for mounting at least one cymbal. The cymbal stand of the present invention comprises a base assembly including a base pipe, a support pipe assembly including a first support pipe and a first locking clamp for releasably locking said first support pipe and said base pipe together. The base pipe has an upper end and a longitudinal axis. The first support pipe has a length, opposite terminal ends and a first longitudinal axis along the length. The first support pipe is telescopically and coaxially movable relative to the base pipe. Moreover, the first support pipe is connected to the base pipe along the longitudinal axis of the first support pipe by the first locking clamp at a nodal point of the first support pipe. As a result, the present invention optimizes and improves cymbal sound and provides better clarity and sustain of the cymbal sound.

According to a second aspect of the invention, a method is provided for setting up a cymbal stand for mounting at least one cymbal. The cymbal stand comprises a base pipe having an upper end and a longitudinal axis, a support pipe assembly including a first support pipe having a length, opposite terminal ends and a first longitudinal axis along said length and a first locking clamp for releasably locking the first support pipe and the base pipe together. The first support pipe is telescopically and coaxially movable relative to the base pipe. The method comprises the steps of adjusting the location of the first support pipe relative to the base pipe along the longitudinal axis of the first support pipe so that a nodal point of the first support pipe substantially coincides with the first locking clamp, and locking the first locking clamp so as to connect the first support pipe to the base pipe at the nodal point of the first support pipe.

This and other advantages of the present invention will be apparent to those of skill in the art when viewed in light of the following description and associated drawings.

BRIEF DESCRIPTION OF THE DRAWINGS

Other objects and advantages of the invention will become apparent from a study of the following specification when viewed in light of the accompanying drawings, wherein:

FIG. 4B is a cross-sectional view of the first support pipe of the cymbal stand;

DETAILED DESCRIPTION OF THE EXEMPLARY EMBODIMENT

Figure 1:
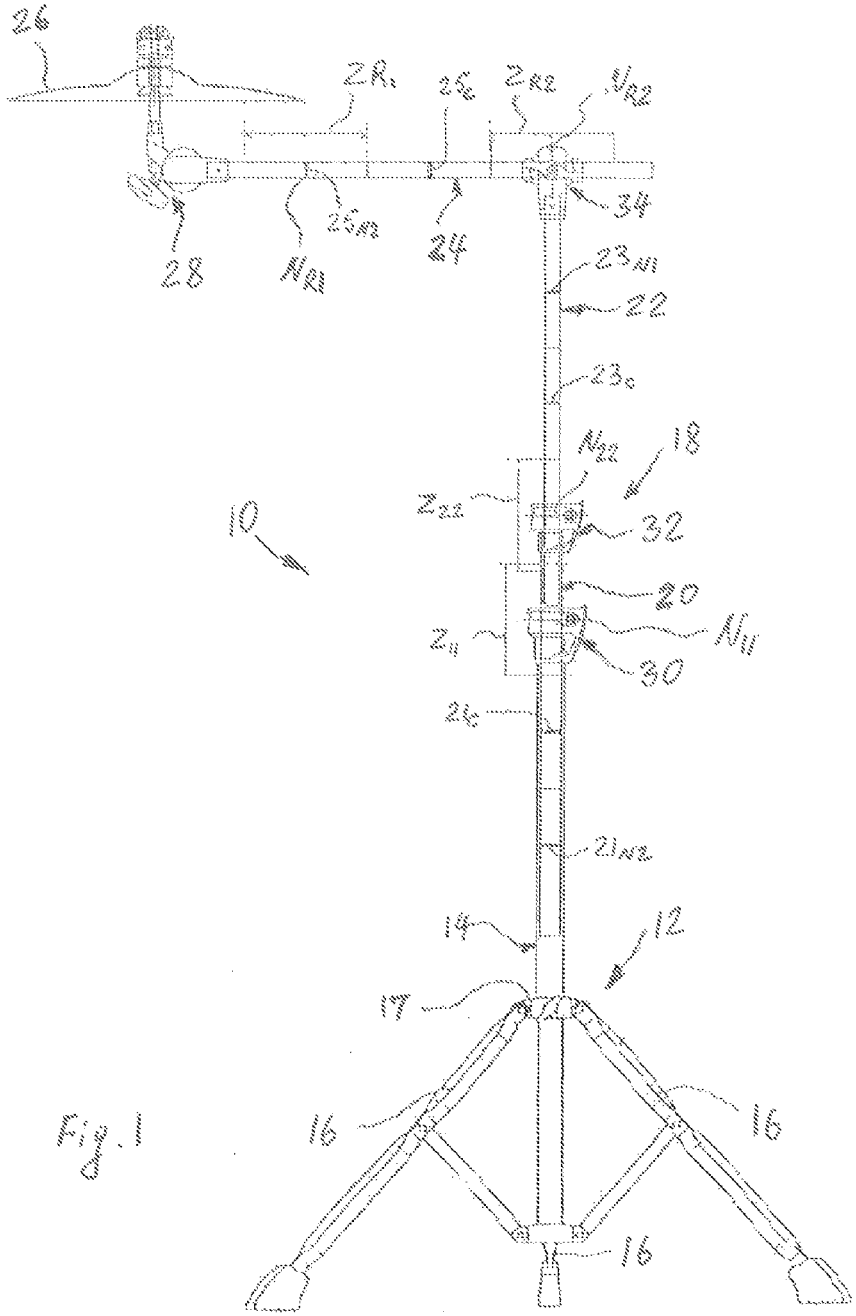
FIG. 1 is an elevation view of a boom cymbal stand according to an exemplary embodiment of the present invention.

Reference will now be made in detail to an exemplary embodiment(s) and method(s) of the present invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "upper" and "lower" as well as derivatives thereof (e.g., "horizontally," "vertically," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

FIG. 1 of the drawings illustrates a cymbal stand according to an exemplary embodiment of the present invention, indicated generally by reference numeral 10. The cymbal stand 10 comprises a base assembly 12, a support pipe assembly 18 adjustably supported by the base assembly 12, a boom rod 24 adjustably supported by the support pipe assembly 18, and a cymbal 26 supported by the boom rod 24 through a cymbal holder 28.

The base assembly 12 comprises a tubular (or cylindrical) base pipe 14 made of metal, and a number of support legs 16 mounted to the base pipe 14 for supporting the base pipe 14 in a generally perpendicular (or upright, vertical) orientation relative to a floor surface. Top ends of the support legs 16 are pivotally mounted to the base pipe 14 through annular support member 17 so as to enable the stand 10 to be erected or folded. As further illustrated in FIG. 2, the base pipe 14 has an upper end $\mathbf{14}_T$ and a longitudinal axis $X_B$.

The support pipe assembly 18 comprises a tubular first support pipe 20 and a second support pipe 22 disposed one above the other, both made of metal. The first support pipe 20, illustrated in detail in FIGS. 3, 4A and 4B, has a length $L_1$, opposite upper and lower terminal ends $\mathbf{20}_T$ and $\mathbf{20}_B$, respectively, and a first longitudinal axis $X_1$ along the length $L_1$. As shown in detail in FIGS. 1 and 2, an outer diameter of the first support pipe 20 is smaller than an inner diameter of the base pipe 14, making it possible for the first support pipe 20 to be coaxially received in the base pipe 14 so as to be telescopically and coaxially movable relative to the base pipe 14. Moreover, the position of the first support pipe 20 relative to the base pipe 14 can be adjustably fixed by a first locking clamp 30 for releasably locking the first support pipe 20 and the base pipe 14 together, thus adjusting and setting the height of the cymbal stand 10. Specifically, the lower terminal end $\mathbf{20}_B$ of the first support pipe 20 is inserted into the upper end $\mathbf{14}_T$ of the base pipe 14 so as to extend from the upper end $\mathbf{14}_T$ thereof. According to the exemplary embodiment of the present invention, the first locking clamp 30 is of conventional design, known in the art, and is provided at the upper end $\mathbf{14}_T$ of the base pipe 14. Further according to the exemplary embodiment of the present invention, the first locking clamp 30 is mounted to the upper end $\mathbf{14}_T$ of the base pipe 14.

It is known in the art that a metal tube (or pipe) has a fundamental, or first, longitudinal harmonic mode of vibration. Moreover, the tube vibrates with two nodal points and three anti-nodal points. The anti-nodal points are the areas of greatest movement, and the nodal points are where no movement occurs. Therefore, nodal points are areas with amplitude of vibration equal to zero. For the first mode, the nodal positions are at 0.224×L, where L represents a total length of the tube.

Figure 3:
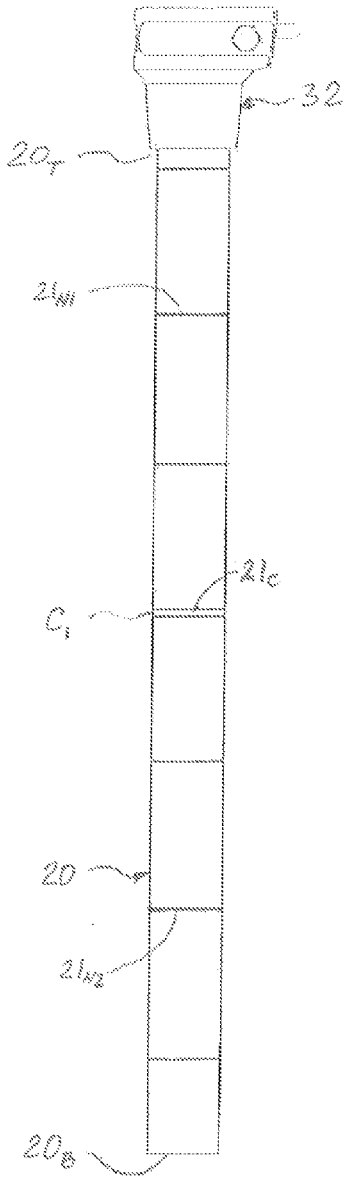
FIG. 3 is an elevation view of a first support pipe of the cymbal stand provided with a first locking clamp.
Figure 4A:
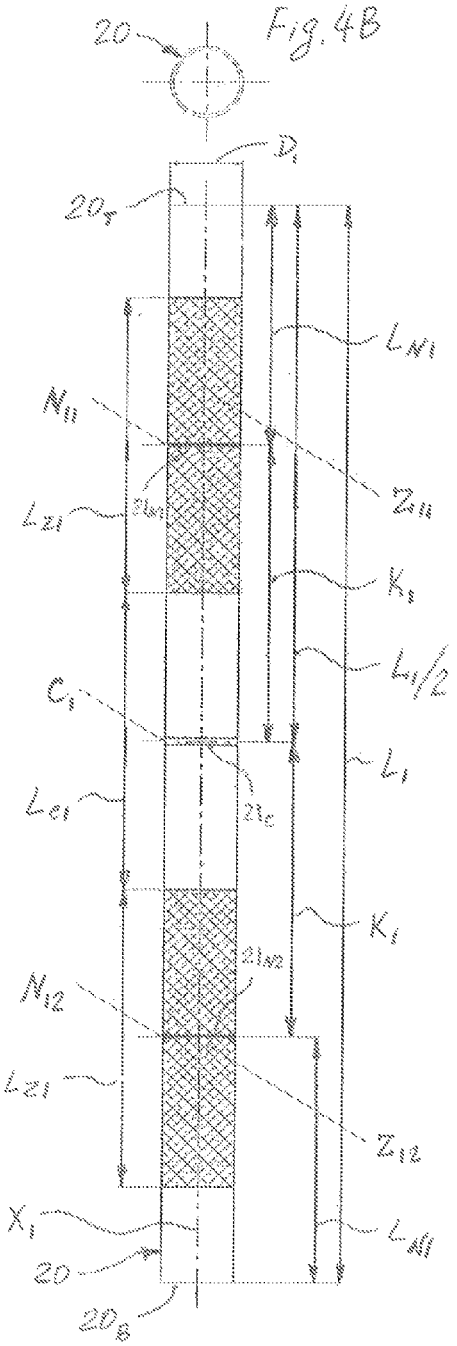
FIG. 4A is an elevation view of the first support pipe of the cymbal stand.

As illustrated in detail in FIGS. 3 and 4A, the first support pipe 20 has two nodal points $N_{11}$ and $N_{12}$ marked on the first support pipe 20 by node mark lines $\mathbf{21}_{N1}$ and $\mathbf{21}_{N2}$, respectively, such as by scribing on an outer peripheral surface of the first support pipe 20, and a center point $C_1$ marked on the first support pipe 20 by a center mark line $\mathbf{21}_C$, such as by scribing on the outer peripheral surface of the first support pipe 20. As further illustrated in FIGS. 3 and 4A, the nodal points $N_{11}$ and $N_{12}$ are located at a distance $L_{N1}$ from the respective terminal ends $\mathbf{20}_T$ and $\mathbf{20}_B$ thereof. In turn, the distance $L_{N1}$ equals 0.224 times the length $L_1$ of the first support pipe 20 measured from one of the terminal ends $\mathbf{20}_T$ and $\mathbf{20}_B$ thereof. In other words, the nodal points $N_{11}$ and $N_{12}$ are located at 0.224 times the length $L_1$ of the first support pipe 20 measured from one of the terminal ends $\mathbf{20}_T$ and $\mathbf{20}_B$ thereof.

As further illustrated in FIGS. 3 and 4A, an area on both sides of each of the nodal points $N_{11}$ and $N_{12}$ along the first longitudinal axis $X_1$ and the length $L_1$ of the first support pipe 20 defines a vibration zone $Z_{11}$ and $Z_{12}$, respectively, which is symmetrical about the nodal point $N_{11}$ or $N_{12}$. As illustrated in FIG. 4, the vibration zone $Z_{11}$ and $Z_{12}$ are marked on the first support pipe 20, such as by scribing or knurling the outer peripheral surface of the first support pipe 20. A length $L_{Z1}$ of each of the vibration zone $Z_{11}$ and $Z_{12}$ is equal to a distance $K_1$ between the center point $C_1$ and one of the nodal points $N_{11}$ and $N_{12}$. Moreover, a distance $L_{C1}$ between the vibration zone $Z_{11}$ and $Z_{12}$ is equal to the distance $K_1$ between the center point $C_1$ and one of the nodal points $N_{11}$ and $N_{12}$ as well as the length $L_{Z1}$ of each of the vibration zone $Z_{11}$ and $Z_{12}$ of the first support pipe 20.

Figure 2:
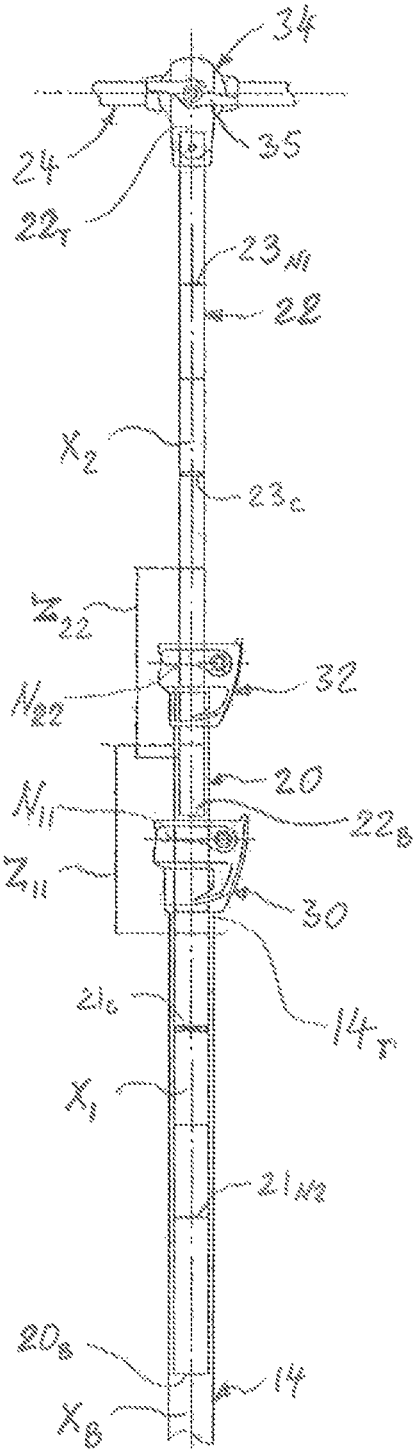
FIG. 2 is a partial elevation view of a stand body of the cymbal stand according to the exemplary embodiment of the present invention.

According to the present invention, as illustrated in FIGS. 1 and 2, the first support pipe 20 is locked (or connected, or coupled) to the base pipe 14 along the longitudinal axis $X_1$ of the first support pipe 20 by the first locking clamp 30 at approximately one of the nodal points $N_{11}$ and $N_{12}$ of the first support pipe 20. In other words, the first support pipe 20 is locked to the base pipe 14 along the longitudinal axis $X_1$ by the first locking clamp 30 at approximately 0.224 times the length $L_1$ measured from one of the terminal ends $\mathbf{20}_T$ and $\mathbf{20}_B$ of the first support pipe 20. Specifically, according to the exemplary embodiment of the present invention as illustrated in FIGS. 1 and 2, the first support pipe 20 is locked to the base pipe 14 by the first locking clamp 30 at approximately the nodal point $N_{11}$ of the first support pipe 20. In other words, the first support pipe 20 is locked to the base pipe 14 at approximately 0.224 times the length $L_1$ measured from the upper terminal end $\mathbf{20}_T$ of the first support pipe 20.

Figures 5, 6:
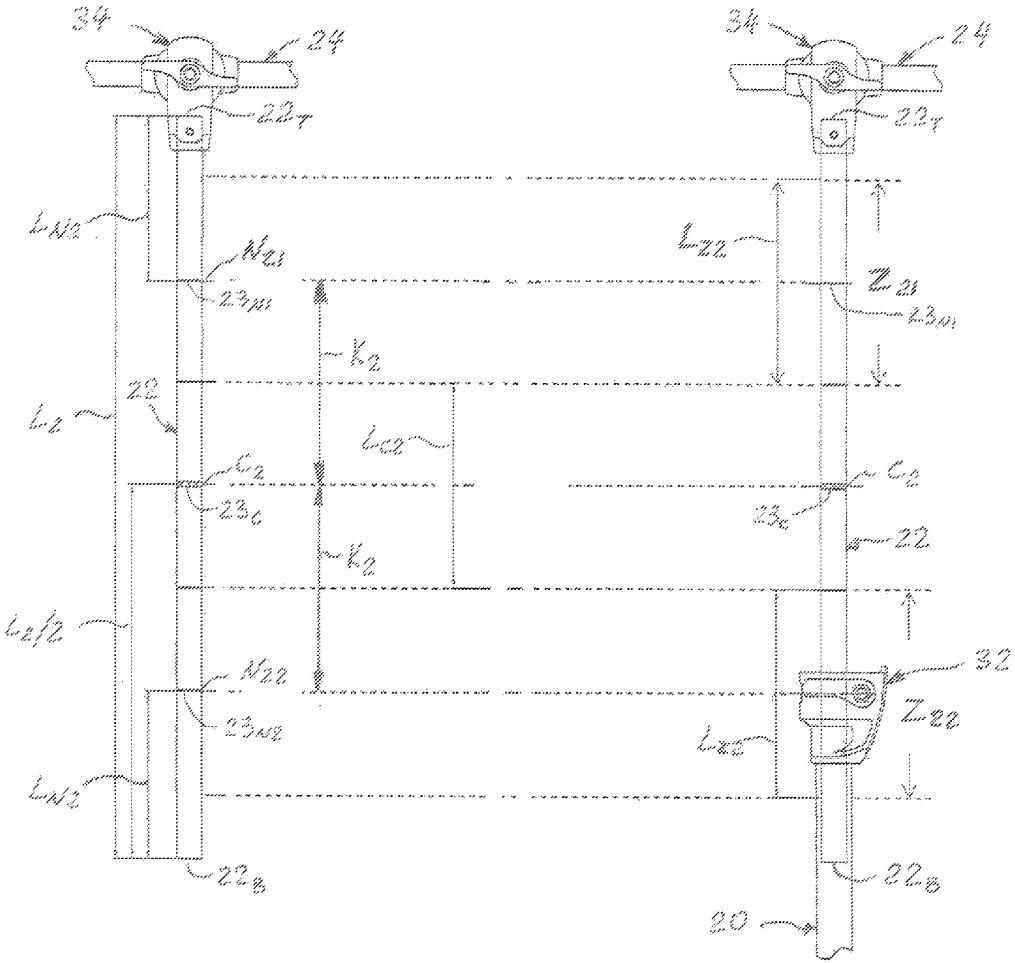
FIG. 5 is an elevation view of a second support pipe of the cymbal stand.
FIG. 6 is an elevation view of the first and second support pipes of the cymbal stand interconnected according to the exemplary embodiment of the present invention.

The second support pipe 22, illustrated in detail in FIGS. 5 and 6, has a length $L_2$, opposite upper and lower terminal ends $\mathbf{22}_T$ and $\mathbf{22}_B$, respectively, and a second longitudinal axis $X_2$ along the length $L_2$. As shown in detail in FIGS. 1, 2 and 6, an outer diameter of the second support pipe 22 is smaller than an inner diameter of the first support pipe 20, making it possible for the second support pipe 22 to be coaxially received in the first support pipe 20 so as to be telescopically and coaxially movable relative to the first support pipe 20. Moreover, the position of the second support pipe 22 relative to the first support pipe 20 can be adjustably fixed by a second locking clamp 32 for releasably locking the first support pipe 20 and the second support pipe 22 together, thus adjusting and setting the height of the cymbal stand 10. Specifically, the lower terminal end $\mathbf{22}_B$ of the second support pipe 22 is inserted into the upper terminal end $\mathbf{20}_T$ of the first support pipe 20 so as to extend from the upper terminal end $\mathbf{20}_T$ thereof. According to the exemplary embodiment of the present invention, the second locking clamp 32 is of conventional design, known in the art, and is provided at the upper terminal end $\mathbf{20}_T$ of the first support pipe 20 as shown in FIGS. 1-3 and 6. Further according to the exemplary embodiment of the present invention, the second locking clamp 32 is mounted to the upper terminal end $\mathbf{20}_T$ of the first support pipe 20.

As illustrated in detail in FIGS. 5 and 6, the second support pipe 22 has two nodal points $N_{21}$ and $N_{22}$ marked on the second support pipe 22 by node mark lines $\mathbf{23}_{N1}$ and $\mathbf{23}_{N2}$, respectively, such as by scribing on the outer peripheral surface of the second support pipe 22, and a center point $C_2$ marked on the second support pipe 22 by a center mark line $\mathbf{23}_C$, such as by scribing on the outer peripheral surface of the second support pipe 22. As further illustrated in FIGS. 5 and 6, the nodal points $N_{21}$ and $N_{22}$ are located at a distance $L_{N2}$ from the respective terminal ends $22_T$ and $22_B$ thereof. In turn, the distance $L_{N2}$ equals 0.224 times the length $L_2$ of the second support pipe 22 measured from one of the terminal ends $22_T$ and $22_B$ thereof. In other words, the nodal points $N_{21}$ and $N_{22}$ are located at 0.224 times the length $L_2$ of the second support pipe 22 measured from one of the terminal ends $22_T$ and $22_B$ thereof.

As further illustrated in FIGS. 5 and 6, an area on both sides of each of the nodal points $N_{21}$ and $N_{22}$ along the second longitudinal axis $X_2$ and the length $L_2$ of the second support pipe 22 defines a vibration zone $Z_{21}$ and $Z_{22}$, respectively, which is symmetrical about the nodal point $N_{21}$ and $N_{22}$. A length $L_{Z2}$ of each of the vibration zone $Z_{21}$ and $Z_{22}$ is equal to a distance $K_2$ between the center point $C_2$ and one of the nodal points $N_{21}$ and $N_{22}$. Moreover, a distance $L_{C2}$ between the vibration zones $Z_{21}$ and $Z_{22}$ is equal to the distance $K_2$ between the center point $C_2$ and one of the nodal points $N_{21}$ and $N_{22}$ as well as the length $L_{Z2}$ of each of the vibration zone $Z_{21}$ and $Z_{22}$ of the second support pipe 22.

According to the present invention, as illustrated in FIGS. 1, 2 and 6, the second support pipe 22 is locked to the first support pipe 20 along the longitudinal axis $X_2$ of the second support pipe 22 by the second locking clamp 32 at approximately one of the nodal points $N_{21}$ and $N_{22}$ of the second support pipe 22. In other words, the second support pipe 22 is locked to the first support pipe 20 along the longitudinal axis $X_2$ by the second locking clamp 32 at approximately 0.224 times the length $L_2$ measured from one of the terminal ends $22_T$ and $22_B$ of the second support pipe 22. Specifically, according to the exemplary embodiment of the present invention as illustrated in FIGS. 1, 2 and 6, the second support pipe 22 is locked to the first support pipe 20 by the second locking clamp 32 at approximately the nodal point $N_{22}$ of the second support pipe 22. In other words, the second support pipe 22 is locked to the first support pipe 20 at approximately 0.224 times the length $L_2$ measured from the lower terminal end $22_B$ of the second support pipe 22.

Figure 8:
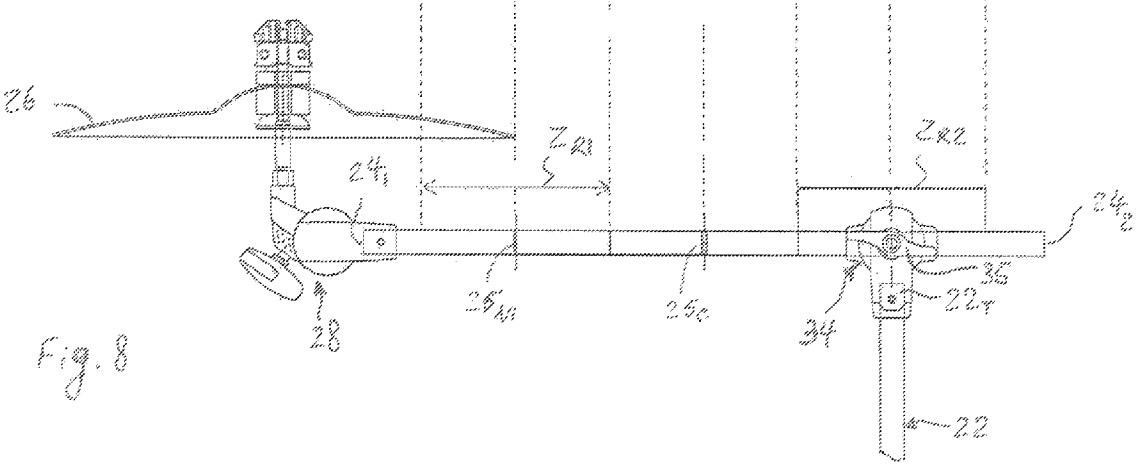
FIG. 8 is an elevation view of the boom rod coupled to the second support pipe according to the exemplary embodiment of the present invention.

The boom rod 24 is adjustably supported by the second support pipe 22 of the support pipe assembly 18. According to the exemplary embodiment of the present invention as illustrated in FIGS. 1, 2 and 8, a rod holder 34 is provided at the upper terminal end $22_T$ of the second support pipe 22. The rod holder 34 enables adjustment of the position of the boom rod 24 and is operable to secure the boom rod 24. The boom rod 24 is inserted into and is held by the rod holder 34. The boom rod 24 is inserted into the rod holder 34 at a desired location and a fixing screw 35 is tightened to secure the boom rod 24.

Figure 7:
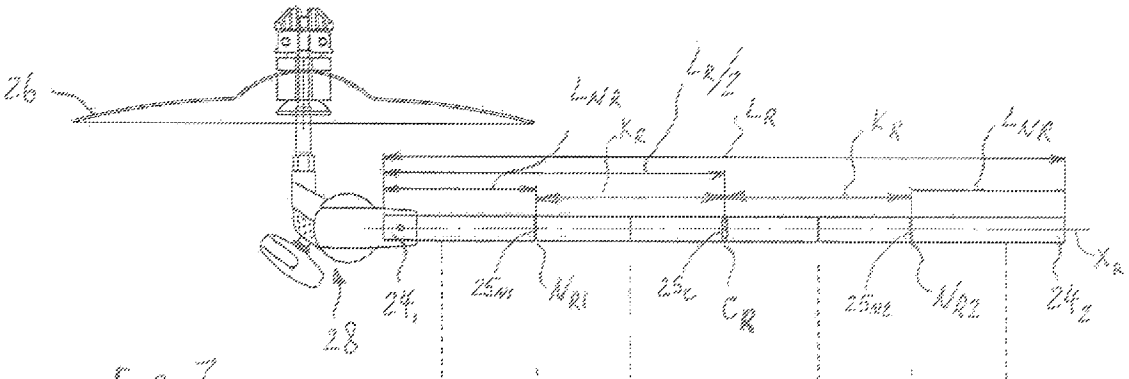
FIG. 7 is an elevation view of a boom rod of the cymbal stand supporting a cymbal.

As illustrated in detail in FIG. 7, the boom rod 24 has a length $L_R$, opposite terminal ends $24_1$ and $24_2$, respectively, and a longitudinal axis $X_R$ along the length $L_R$. One of the terminal ends $24_1$ of the boom rod 24 is provided with the cymbal holder 28 for supporting the cymbal on the boom rod 24.

As illustrated in detail in FIGS. 7 and 8, the boom rod 24 has two nodal points $N_{R1}$ and $N_{R2}$ marked on the boom rod 24 by node mark lines $25_{N1}$ and $25_{N2}$, respectively, such as by scribing on an outer peripheral surface of the boom rod 24, and a center point $C_R$ marked on the boom rod 24 by a center mark line $25_C$, such as by scribing on the outer peripheral surface of the boom rod 24. As further illustrated in FIGS. 7 and 8, the nodal points $N_{R1}$ and $N_{R2}$ of the boom rod 24 are located at a distance $L_{NR}$ from the respective terminal ends $24_1$ and $24_2$ thereof. In turn, the distance $L_{NR}$ equals 0.224 times the length $L_R$ of the boom rod 24 measured from one of the terminal ends $24_1$ and $24_2$ thereof. In other words, the nodal points $N_{R1}$ and $N_{R2}$ are located at 0.224 times the length $L_R$ of the boom rod 24 measured from one of the terminal ends $24_1$ and $24_2$ thereof.

As further illustrated in FIGS. 7 and 8, an area on both sides of each of the nodal points $N_{R1}$ and $N_{R2}$ along the longitudinal axis $X_R$ and the length $L_R$ of the boom rod 24 defines a vibration zone $Z_{R1}$ and $Z_{R2}$, respectively, which is symmetrical about the nodal point $N_{R1}$ and $N_{R2}$. A length $L_{RZ}$ of each of the vibration zone $Z_{R1}$ and $Z_{R2}$ is equal to a distance $K_R$ between the center point $C_R$ and one of the nodal points $N_{R1}$ and $N_{R2}$. Moreover, a distance $L_{CR}$ between the vibration zone $Z_{R1}$ and $Z_{R2}$ is equal to the distance $K_R$ between the center point $C_R$ and one of the nodal points $N_{R1}$ and $N_{R2}$ as well as the length $L_{RZ}$ of each of the vibration zone $Z_{R1}$ and $Z_{R2}$ of the boom rod 24.

According to the present invention, as illustrated in FIGS. 1 and 8, the boom rod 24 is locked to the second support pipe 22 along the longitudinal axis $X_R$ of the boom rod 24 by the rod holder 34 at approximately one of the nodal points $N_{R1}$ and $N_{R2}$ of the boom rod 24. In other words, the boom rod 24 is locked to the second support pipe 22 along the longitudinal axis $X_R$ by the rod holder 34 at approximately 0.224 times the length $L_R$ measured from one of the terminal ends $24_1$ and $24_2$ of the boom rod 24. Specifically, according to the exemplary embodiment of the present invention as illustrated in FIGS. 1 and 8, the boom rod 24 is locked to the second support pipe 22 by the rod holder 34 at approximately the nodal point $N_{R2}$ of the boom rod 24. In other words, the boom rod 24 is locked to the second support pipe 22 at approximately 0.224 times the length $L_R$ measured from the right terminal end $24_2$ (as shown in FIGS. 7 and 8) of the boom rod 24.

In operation, a method for setting up the cymbal stand 10 is as follows. First, the first support pipe 20 is coaxially inserted into the base pipe 14 and the first support pipe 20 is adjusted relative to the base pipe 14 so as to locate one of the nodal points $N_{11}$ and $N_{12}$ (or one of the mark lines $21_{N1}$ and $21_{N2}$) of the first support pipe 20 (such as the upper nodal point $N_{11}$ (mark line $21_{N1}$)) at a position substantially corresponding to (i.e., substantially coinciding with) the first locking clamp 30, as shown in FIGS. 1 and 2. Then, the first locking clamp 30 is locked so as to connect the first support pipe 20 to the base pipe 14 at the nodal point $N_{11}$ of the first support pipe 20.

Next, the second support pipe 22 is coaxially inserted into the first support pipe 20 and the second support pipe 22 is adjusted relative to the first support pipe 20 so as to locate one of the nodal points $N_{21}$ and $N_{22}$ (or one of the mark lines $23_{N1}$ and $23_{N2}$) of the second support pipe 22 (such as the lower nodal point $N_{22}$ (mark line $23_{N2}$)) at a position substantially corresponding to the second locking clamp 32, as shown in FIGS. 1, 2 and 6. Then, the second locking clamp 32 is locked so as to connect the second support pipe 22 to the first support pipe 20 at the nodal point $N_{22}$ of the second support pipe 22.

After that, the boom rod 24 is adjustably attached to the second support pipe 22 by the rod holder 34 provided at the upper terminal end $22_T$ of the second support pipe 22. Then, the boom rod 24 is adjusted relative to the second support pipe 22 so as to locate one of the nodal points $N_{R1}$ and $N_{R2}$ (or one of the mark lines $25_{N1}$ and $25_{N2}$) of the boom rod 24 (such as the lower nodal point $N_{R2}$ (mark line $25_{N2}$) in FIGS. 1 and 8) at a position substantially corresponding to the rod holder 34, as shown in FIGS. 1 and 8. Then, the rod holder 34 is locked so as to connect the boom rod 24 to the second support pipe 22 at the nodal point $N_{R2}$ of the boom rod 24.

The above described arrangement of the novel cymbal stand 10 and the method for setting up the same according to the present invention, that includes support pipes and a boom rod coupled to each other at nodal points thereof, optimizes and improves cymbal sound and provides better clarity and sustain of the cymbal sound.

The foregoing description of the exemplary embodiment of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A cymbal stand for mounting at least one cymbal, said cymbal stand comprising:

a base assembly including a base pipe, said base pipe having an upper end and a longitudinal axis;

a support pipe assembly including a first support pipe having a length, opposite terminal ends and a first longitudinal axis along said length, said first support pipe telescopically and coaxially movable relative to said base pipe; and a first locking clamp for releasably locking said first support pipe and said base pipe together;

said first support pipe being connected to said base pipe along said longitudinal axis of said first support pipe by said first locking clamp at a nodal point of said first support pipe, wherein said nodal point is an area with amplitude of vibration equal to zero.

2. The cymbal stand as defined in claim 1, wherein said nodal point of said first support pipe is located at a distance of approximately 0.224 times said length of said first support pipe measured from one of said terminal ends thereof.

3. The cymbal stand as defined in claim 1, further comprising a second support pipe having a length, opposite terminal ends and a second longitudinal axis along said length, said second support pipe telescopically and coaxially movable relative to said first support pipe; and a second locking clamp for releasably locking said second support pipe and said first support pipe together.

4. The cymbal stand as defined in claim 3, wherein said second support pipe is connected to said first support pipe along said longitudinal axis of said second support pipe by said second locking clamp at a nodal point of said second support pipe.

5. The cymbal stand as defined in claim 4, wherein said nodal point of said second support pipe is located at a distance of approximately 0.224 times said length of said second support pipe measured from one of said terminal ends thereof.

6. The cymbal stand as defined in claim 4, further comprising a boom rod having a length, opposite terminal ends and a longitudinal axis along said length; and a rod holder provided at an upper terminal end of said second support pipe for releasably connecting said boom rod and said second support pipe together.

7. The cymbal stand as defined in claim 6, wherein said boom rod is connected to said second support pipe along said longitudinal axis of said boom rod by said rod holder at a nodal point of said boom rod.

8. The cymbal stand as defined in claim 6, wherein said nodal point of said boom rod is located at a distance of approximately 0.224 times said length of said boom rod measured from one of said terminal ends thereof.

9. The cymbal stand as defined in claim 3, further comprising a boom rod having a length, opposite terminal ends and a longitudinal axis along said length; and a rod holder provided at an upper terminal end of said second support pipe for releasably connecting said boom rod and said second support pipe together.

10. The cymbal stand as defined in claim 9, wherein said boom rod is connected to said second support pipe along said longitudinal axis of said boom rod by said rod holder at a nodal point of said boom rod.

11. The cymbal stand as defined in claim 10, wherein said nodal point of said boom rod is located at a distance of approximately 0.224 times said length of said boom rod measured from one of said terminal ends thereof.

12. The cymbal stand as defined in claim 3, wherein said nodal point of said second support pipe is marked on said second support pipe by a node mark line formed on an outer peripheral surface of said second support pipe.

13. The cymbal stand as defined in claim 12, wherein a center point of said second support pipe is marked on said second support pipe by a center mark line formed on said outer peripheral surface of said second support pipe.

14. The cymbal stand as defined in claim 1, further comprising a boom rod having a length, opposite terminal ends and a longitudinal axis along said length; and a rod holder provided at an upper terminal end of said support pipe assembly for releasably connecting said boom rod and said support pipe assembly together.

15. The cymbal stand as defined in claim 14, wherein said boom rod is connected to said support pipe assembly along said longitudinal axis of said boom rod by said rod holder at a nodal point of said boom rod.

16. The cymbal stand as defined in claim 15, wherein said nodal point of said boom rod is located at a distance of approximately 0.224 times said length of said boom rod measured from one of said terminal ends thereof.

17. The cymbal stand as defined in claim 14, wherein said nodal point of said boom rod is marked on said boom rod by a node mark line formed on an outer peripheral surface of said boom rod.

18. The cymbal stand as defined in claim 17, wherein a center point of said boom rod is marked on said boom rod by a center mark line formed on said outer peripheral surface of said boom rod.

19. The cymbal stand as defined in claim 1, further comprising a number of support legs mounted to said base pipe for supporting said base pipe in a generally perpendicular orientation relative to a floor surface.

20. The cymbal stand as defined in claim 1, wherein said nodal point of said first support pipe is marked on said first support pipe by a node mark line formed on an outer peripheral surface of said first support pipe.

21. The cymbal stand as defined in claim 20, wherein a center point of said first support pipe is marked on said first support pipe by a center mark line formed on said outer peripheral surface of said first support pipe.

22. A method of setting up a cymbal stand for mounting at least one cymbal, said cymbal stand comprising a base pipe having an upper end and a longitudinal axis, a support pipe assembly including a first support pipe having a length, opposite terminal ends and a first longitudinal axis along said length and a first locking clamp for releasably locking said first support pipe and said base pipe together, said first support pipe telescopically and coaxially movable relative to said base pipe, said method comprising the steps of:

adjusting the location of said first support pipe relative to said base pipe along said longitudinal axis of said first support pipe so that a nodal point of said first support pipe substantially coincides with said first locking clamp; and locking said first locking clamp so as to connect said first support pipe to said base pipe at said nodal point of said first support pipe; wherein said nodal point is an area with amplitude of vibration equal to zero.

23. The method as defined in claim 22, wherein said nodal point of said first support pipe is located at a distance of approximately 0.224 times said length of said first support pipe measured from one of said terminal ends thereof.

24. The method as defined in claim 22, wherein said cymbal stand further comprises a second support pipe having a length, opposite terminal ends and a second longitudinal axis along said length, and a second locking clamp for releasably locking said second support pipe and said first support pipe together; said second support pipe telescopically and coaxially movable relative to said first support pipe; said method further comprising the steps of:

adjusting the location of said second support pipe relative to said first support pipe along said longitudinal axis of said second support pipe so that a nodal point of said second support pipe substantially coincides with said second locking clamp; and locking said second locking clamp so as to connect said second support pipe to said first support pipe at said nodal point of said second support pipe.

25. The method as defined in claim 24, wherein said nodal point of said second support pipe is located at a distance of approximately 0.224 times said length of said second support pipe measured from one of said terminal ends thereof.

26. The method as defined in claim 24, wherein said cymbal stand further comprises a boom rod having a length, opposite terminal ends and a longitudinal axis along said length, and a rod holder provided at an upper terminal end of said support pipe assembly for releasably connecting said boom rod and said support pipe assembly together; said method further comprising the steps of:

adjusting the location of said boom rod relative to said second support pipe along said longitudinal axis of said boom rod so that a nodal point of said boom rod substantially coincides with said rod holder; and locking said rod holder so as to connect said boom rod to said second support pipe at said nodal point of said boom rod.

27. The method as defined in claim 26, wherein said nodal point of said boom rod is located at a distance of approximately 0.224 times said length of said boom rod measured from one of said terminal ends thereof.

28. A cymbal stand for mounting at least one cymbal, said cymbal stand comprising:

a base assembly including a base pipe, said base pipe having an upper end and a longitudinal axis;

a support pipe assembly including a first support pipe having a length, opposite terminal ends and a first longitudinal axis along said length, said first support pipe telescopically and coaxially movable relative to said base pipe; and a first locking clamp for releasably locking said first support pipe and said base pipe together;

said first support pipe being connected to said base pipe along said longitudinal axis of said first support pipe by said first locking clamp at a nodal point of said first support pipe; wherein said nodal point of said first support pipe is located at a distance of approximately 0.224 times said length of said first support pipe measured from one of said terminal ends thereof; wherein said nodal point is an area with amplitude of vibration equal to zero.

* * * * *